US010124399B2

(12) United States Patent
Seiler et al.

(10) Patent No.: US 10,124,399 B2
(45) Date of Patent: Nov. 13, 2018

(54) MOLDING SAND COOLER

(71) Applicant: Maschinenfabrik Gustav Eirich GmbH & Co. KG, Hardheim (DE)

(72) Inventors: Andreas Seiler, Tauberbischofsheim (DE); Feng Li, Jiangyin (CN); Stefan Gerl, Werbach (DE)

(73) Assignee: Maschinenfabrik Gustav Eirich GmbH & Co. KG (DE)

( * ) Notice: Subject to any disclaimer, the term of this patent is extended or adjusted under 35 U.S.C. 154(b) by 0 days.

(21) Appl. No.: 15/552,412

(22) PCT Filed: Mar. 18, 2016

(86) PCT No.: PCT/EP2016/055911
§ 371 (c)(1),
(2) Date: Aug. 21, 2017

(87) PCT Pub. No.: WO2016/150835
PCT Pub. Date: Sep. 29, 2016

(65) Prior Publication Data

US 2018/0029108 A1 Feb. 1, 2018

(30) Foreign Application Priority Data

Mar. 23, 2015 (DE) ..... 10 2015 104 340

(51) Int. Cl.
*B03B 7/00* (2006.01)
*B22C 5/08* (2006.01)
(Continued)

(52) U.S. Cl.
CPC ..... *B22C 5/08* (2013.01); *B01F 7/165* (2013.01); *B01F 7/1665* (2013.01);
(Continued)

(58) Field of Classification Search
CPC ..... B22C 5/08; B22C 5/085; B01F 2015/061; B01F 7/165; B01F 7/1665
(Continued)

(56) References Cited

U.S. PATENT DOCUMENTS 3,406,950 A * 10/1968 McIlvaine ..... B01F 15/063 366/13
3,456,906 A * 7/1969 Troy ..... B01F 7/165 241/102
(Continued)

FOREIGN PATENT DOCUMENTS

CN 201757606 U 3/2011
CN 102430708 A 5/2012
(Continued)

OTHER PUBLICATIONS

Office Action, Russian Patent Application No. 2017 134 859, dated May 14, 2018 and English Translation of Office Action.
(Continued)

*Primary Examiner* — Terrell H Matthews
(74) *Attorney, Agent, or Firm* — Paul & Paul

(57) ABSTRACT

The present invention concerns a casting sand cooler comprising a sand chamber having an air inlet optionally with a fan for the feed of air into the sand chamber and an air outlet optionally with a fan for sucking air out of the sand chamber. To provide an improved casting sand cooler in which the sand discharge during the cooling operation by way of the air outlet is markedly reduced, it is proposed according to the invention that a dynamic wind sifter which is rotatable about an axis and which is so arranged that substantially the complete air flow leaving the sand chamber through the air outlet is passed through the dynamic wind sifter.

20 Claims, 6 Drawing Sheets

(51) Int. Cl.

| | |
|---|---|
| ***B01F 7/16*** | (2006.01) |
| ***B22C 5/04*** | (2006.01) |
| ***B22C 5/18*** | (2006.01) |
| ***B01F 15/00*** | (2006.01) |
| ***B01F 15/06*** | (2006.01) |
| *B07B 9/00* | (2006.01) |

(52) U.S. Cl.
CPC ..... *B01F 15/00538* (2013.01); *B01F 15/06* (2013.01); *B22C 5/044* (2013.01); *B22C 5/0422* (2013.01); *B22C 5/18* (2013.01); *B01F 2015/061* (2013.01)

(58) Field of Classification Search
USPC ..... 209/12.1, 21
See application file for complete search history.

(56) References Cited

U.S. PATENT DOCUMENTS

| | | | | | |
|---|---|---|---|---|---|
| 3,599,649 | A * | 8/1971 | Troy | B01F 15/06 | 134/57 R |
| 3,721,014 | A * | 3/1973 | Voelskow | F26B 3/00 | 209/11 |
| 3,958,623 | A * | 5/1976 | Vissers | B22D 31/007 | 164/412 |
| 4,991,721 | A * | 2/1991 | Misra | B07B 4/02 | 209/139.1 |
| 5,032,222 | A * | 7/1991 | Millioud | B01D 1/18 | 159/16.1 |
| 5,289,920 | A * | 3/1994 | Godderidge | B22C 5/08 | 110/236 |
| 5,392,998 | A * | 2/1995 | Suessegger | B02C 21/00 | 209/143 |
| 5,429,248 | A * | 7/1995 | Le Gigan | B07B 1/24 | 209/239 |
| 6,347,707 | B1 * | 2/2002 | Sussegger | B02C 23/12 | 209/133 |
| 7,104,403 | B1 * | 9/2006 | Stephens | B07B 7/04 | 209/132 |
| 7,780,012 | B2 | 8/2010 | Prignon | | |
| 2014/0306044 | A1 * | 10/2014 | Guenter | B07B 4/04 | 241/42 |
| 2018/0029108 | A1 * | 2/2018 | Seiler | B22C 5/08 | |

FOREIGN PATENT DOCUMENTS

| | | | |
|---|---|---|---|
| DE | 1508698 | B1 | 2/1970 |
| DE | 3903604 | C1 | 3/1990 |
| DE | 4223762 | A1 | 1/1994 |
| DE | 9304046 | U1 | 7/1994 |
| DE | 9304698 | U1 | 7/1994 |
| DE | 19925720 | C1 | 11/2000 |
| EP | 0456027 | A | 11/1991 |
| EP | 0519535 | A1 | 12/1992 |
| JP | 2011-087868 | A | 11/2012 |
| RU | 2364448 | C2 | 8/2009 |
| RU | 2403979 | C2 | 5/2010 |
| SU | 1069924 | A | 1/1984 |

OTHER PUBLICATIONS

Japanese Patent Office, Appln. No. 2017-547469, Office Action, dated Mar. 15, 2018, and English translation.
Office Action, Chinese Patent Application No. 201680012780.9, dated Apr. 20, 2018 and English Translation of Office Action.

* cited by examiner

MOLDING SAND COOLER

CROSS-REFERENCE TO RELATED APPLICATIONS

This application is a 371 national stage application of International Application PCT/EP2016/055911, filed Mar. 18, 2016, and claims the priority of German Application No. 10 2015 104 340.8, filed on Mar. 23, 2015.

The present invention concerns an apparatus for cooling warm foundry casting sand. Such apparatuses are also referred to as casting sand coolers.

Used foundry casting sand can be re-used if the foundry casting sand is treated. For that purpose it is necessary to cool down the used sand.

Such an apparatus is known for example from DE 1 508 698. The apparatus described therein comprises a mixing container and has two vertically arranged drive shafts carrying a mixing tool. The foundry casting sand to be cooled is introduced into the mixing container on one side and removed on the other side. While the foundry sand to be cooled is in the apparatus the foundry sand is thoroughly mixed by means of the mixing tools. In addition directly at the container bottom the mixing container has an opening for the feed of air in the container wall.

The endeavour with that apparatus is to produce a water-sprayed, mechanically assisted fluidised bed through which air flows in order to cool the foundry sand which has been heated to up to 150° by the preceding casting operation to the temperature of use of about 45° C. by means of evaporative cooling.

In a subsequent mixer the correspondingly cooled casting sand can be treated with the addition of fresh sand, bentonite, carbon and water to put it into the condition of use for the following utilisation.

In the state of the art the described cooling procedure is effected is various configurations which can be divided into continuous processes and discontinuous processes. For that purpose cooling drums, fluidised bed coolers or mixing coolers are used, in which either casting sand which is to be treated is supplied continuously or in which the corresponding casting sand is supplied batch-wise, that is to say discontinuously.

What is common to the described coolers is that the hot dry sand which is introduced into the cooler, generally into a sand chamber, is moistened by spraying in water and is then cooled from between about 70 to 100° C. to about 45° C. by passing large amounts of air through it and over it, utilising evaporative cooling.

The correspondingly cooled sand leaves the cooler with a moisture content of between about 1 and 2%. The corresponding coolers generally have a sand chamber having an air inlet, possibly with a fan for feeding air into the sand chamber and an air outlet, possibly with a fan for sucking air out of the sand chamber.

Particularly when using fluidised bed and mixing coolers however, by virtue of the turbulent eddying of the sand to be cooled solid particles of the particle fill are drawn away with the introduced gas flow, and those particles are discharged by way of the air outlet and then have to be separated off in downstream-disposed gas cyclones or filters, as described for example in DE 199 25 720. The solids which are separated off in that way are applied to the discharged cooled sand and fed to a mixer in the subsequent treatment process.

To achieve effective cooling by means of evaporative cooling however very large amount of gas flow have to be passed through the casting sand. In the case of fluidised bed coolers, by virtue of the afflux flow speeds of the fluid, being very high due to the principle involved, into the sand bed to be fluidised, solid contents in the discharge gas flow of up to 15% are found to occur. When using mixing coolers, by virtue of the mechanically produced fluidised bed, a lower afflux flow speed is adequate so that the discharge of solids is less but still considerable. At any event however a considerable amount of sand is removed from the cooler and has to be recycled to the process in a separate working step after corresponding cooling. That is basically undesirable.

Taking the described state of the art as the basic starting point the object of the present invention is therefore that of providing an improved casting sand cooler in which the discharge of sand during the cooling operation by way of the air outlet is markedly reduced.

According to the invention that object is attained in that there is provided a dynamic wind sifter which is rotatable about an axis and which is so arranged that substantially the complete air flow leaving the sand chamber through the air outlet is passed through the dynamic wind sifter.

A dynamic wind sifter is so constructed that a centrifugal force field is implemented thereby. The air possibly loaded with sand particles is then sucked within the dynamic wind sifter against the centrifugal force. It is therefore possible by means of a wind sifter when same is operated with a suitably high rotary speed for the solid particles to be removed from the discharge air flow so that they remain in the sand chamber or can be returned into same.

In a preferred embodiment the dynamic wind sifter has a sifter wheel which is rotatable about an axis of rotation and which has an outlet which substantially surrounds the axis of rotation and which is connected to the air outlet, and which has at least one inlet not arranged on the axis of rotation. For example the sifter wheel can be cylindrical, conical or frustoconical, the at least one inlet being arranged at the peripheral surface of the sifter wheel. In general however the sifter wheel has a plurality of inlet openings. For example the peripheral surface can have a plurality of holes. As an alternative thereto the sifter wheel can have a plurality of plates which are mutually spaced so that the inlets are formed by the spacing between the plates. Rotation of the sifter wheel causes the production of a centrifugal force field therein so that a centrifugal force acts outwardly on all particles which are within the sifter wheel. The centrifugal force is opposed by the force which is exerted on the particles by the air flow into the sifter wheel. As the centrifugal force rises proportionally to the particle mass particles of a given limit size are rejected by the wind sifter as for those particles the centrifugal force is higher than the force applied by the air flow.

Basically, by means of such a dynamic wind sifter, coarse and fine material can be separated from each other as the fine material overcomes the centrifugal force and is passed through the wind sifter while coarse material is rejected by the sifter wheel and drops back into the sand chamber.

The axis of rotation can be oriented vertically, horizontally or inclinedly relative to the vertical.

In a further particularly preferred embodiment the casting sand cooler has at least two dynamic wind sifters as it has been found that the reduction in sand discharge can be effected more effectively with a plurality of wind sifters. Alternatively it would naturally also be possible for the single wind sifter to be larger. The provision of the casting sand cooler with a plurality of wind sifters has been proven however to be more effective.

For example the casting sand cooler can have a casting sand inlet by way of which casting sand can be fed into the sand chamber and a casting sand outlet by way of which casting sand can be removed from the sand chamber, in which case then one wind sifter is best arranged closer to the casting sand outlet than the other one. Particularly in the case of continuous operation the wind sifters can be of differing sizes and/or can be operated at differing rotary speeds in order to take account of the progressive cooling and the change in consistency, linked thereto, of the casting sand during the continuous cooling process.

A further preferred embodiment provides that the casting sand cooler additionally has a static wind sifter, for example a deflection separator. It is particularly preferred in that case for the static wind sifter to be disposed upstream of the dynamic wind sifter. The static wind sifter differs from the dynamic wind sifter in that the sifter is not rotated to generate a centrifugal force field. Instead for example the force of gravity and the flow resistance force caused by the air flow can provide for the separation of coarse and fine material. Alternatively it is also possible to use a deflection separator using separation by virtue of the inertia forces at a deflection. The flow follows the deflection so that, in the region of the deflection, inertia forces occur leading to the separation of coarse and fine material. In general static wind sifters are not as effective as dynamic wind sifters. Particularly when very large amounts of sand which are discharged with the air are involved the maximum capacity of a dynamic wind sifter is quickly reached. The dynamic wind sifter can be relieved of load by the upstream connection of a static wind sifter which already provides for pre-selection of coarse material.

In a particularly preferred embodiment the casting sand cooler has a sifter chamber in which the dynamic wind sifter is arranged. In that case the sand chamber is connected to the sifter chamber by way of a flow passage, the cross-section of the flow passage becoming smaller in the direction of the sifter chamber. The reduction in the flow cross-section causes an increase in the flow speed. The flow passage is advantageously so arranged that the fluid flow passed from the sand chamber into the sifter wheel by way of the flow passage is directed on to a wall of the sifter chamber and not on to the dynamic sifter. That causes a sharp deflection in the direction of the gas flow as the air is sucked away by the dynamic wind sifter.

A further preferred embodiment provides that the sifter chamber is connected to the sand chamber by way of a return passage, wherein there is preferably provided a conveyor device and more specifically best a screw conveyor to convey loose material collected on the bottom of the sifter chamber into the sand chamber.

Because a static wind sifter is provided in the sifter chamber that results in a collection of the loose material which was rejected by the two sifters. That loose material can be passed into the casting sand cooler. For that purpose, besides a conveyor device, it is possible to provide for example a flap or a double flap with which the collected loose material can be returned from the sifter chamber into the sand chamber. A particularly preferred embodiment is one in which a conveyor device conveys collected loose material back into the sand chamber permanently or at regular intervals.

In a further preferred embodiment there is provided a rotary speed device for open-loop or closed-loop control of the rotary speed of the dynamic wind sifter. The separation between coarse and fine material can be adjusted by the variation in the rotary speed of the dynamic wind sifter. The faster the wind sifter rotates, the correspondingly more proportions of sand are rejected by the wind sifter. By virtue of the operating principle of the wind sifters particles which exceed a certain limit size are rejected while smaller particles can pass unimpededly through the wind sifter. The limit size can be adjusted by the rotary speed. The higher the rotary speed the correspondingly smaller is the limit size and vice-versa. Preferably the rotary speed device is so designed that the rotary speed is so high that all particles are completely separated off in the sand chamber.

In a further preferred embodiment there is provided a device for detecting the quantitative air flow through the air outlet, wherein the detected quantitative air flow is made available to the rotary speed device, so that the rotary speed device can provide for open-loop or closed-loop control of the rotary speed in dependence on the detected quantitative air flow. The described limit size, that is to say the size up to which the particles are rejected by the wind sifter is determined not only by the rotary speed of the wind sifter but equally by the flow speed of the air flow from the air inlet to the air outlet. If therefore for example the flow speed drops the rotary speed of the wind sifter can be reduced, which saves on energy.

Particularly when using a discontinuous casting sand cooler or batch casting sand cooler the rotary speed device can also be so designed that the rotary speed is increased during the casting sand cooling operation. In particular the rotary speed can be reduced or the rotation can even be stopped during filling or emptying of the sand chamber with casting sand to be cooled. In the course of the casting sand cooling operation the rotary speed can then be increased and matched to the different treatment phases.

In addition there can be provided a device for detecting the particle discharge and/or the particle size distribution by way of the air outlet, wherein the detected particle discharge is made available to the rotary speed device, so that the rotary speed device can be so adapted that the rotary speed is subjected to open-loop or closed-loop control in dependence on the detected particle discharge.

In addition there can be provided a device for feeding water into the sand chamber, wherein there is preferably provided a water control device to which the detected particle discharge and optionally the rotary speed of the dynamic wind sifter is made available and which is so designed that the fed amount of water is effected in dependence on the detected particle discharge and optionally the rotary speed of the dynamic wind sifter. Basically particle discharge detection serves here indirectly as moisture measurement. The drier the sand in the cooler the correspondingly higher is the solids discharge by way of the wind sifters. If therefore a high solids discharge is detected this means that the sand is relatively dry and water still has to be possibly added.

In a further preferred embodiment there is provided a moisture sensor for detecting the moisture in the sand in the sand chamber, wherein preferably the moisture sensor is connected to the rotary speed device and same is so designed that the rotary speed is subjected to open-loop or closed-loop control in dependence on the detected moisture. If as described here there is a moisture sensor a particle discharge sensor does not necessarily additionally have to be provided for the moisture sensor can also be used for actuation of the rotary speed device by virtue of the relationship between moisture and particle discharge.

In a further preferred embodiment it is provided that the rotary speed device is so designed that it provides for open-loop or closed-loop control of the rotary speed in such a way that large particles whose grain size is larger than a predetermined limit grain size are separated off by the wind sifter while smaller particles of a grain size smaller than the predetermined limit grain size are drawn off by way of the air outlet. Preferably the limit grain size selected is a size of between 120 μm and 10 μm and particularly preferably between 30 μm and 60 μm.

By virtue of that measure it is for example possible to remove only the additives like for example carbon and bentonite from the casting sand to be treated while sand constituents remain in the casting sand. The sand-free bentonite and carbon recovered in that way can be recycled to the downstream-disposed treatment process.

Further advantages, features and possible uses will be apparent from the following description of a number of preferred embodiments and the accompanying drawings in which.

Figure 1:
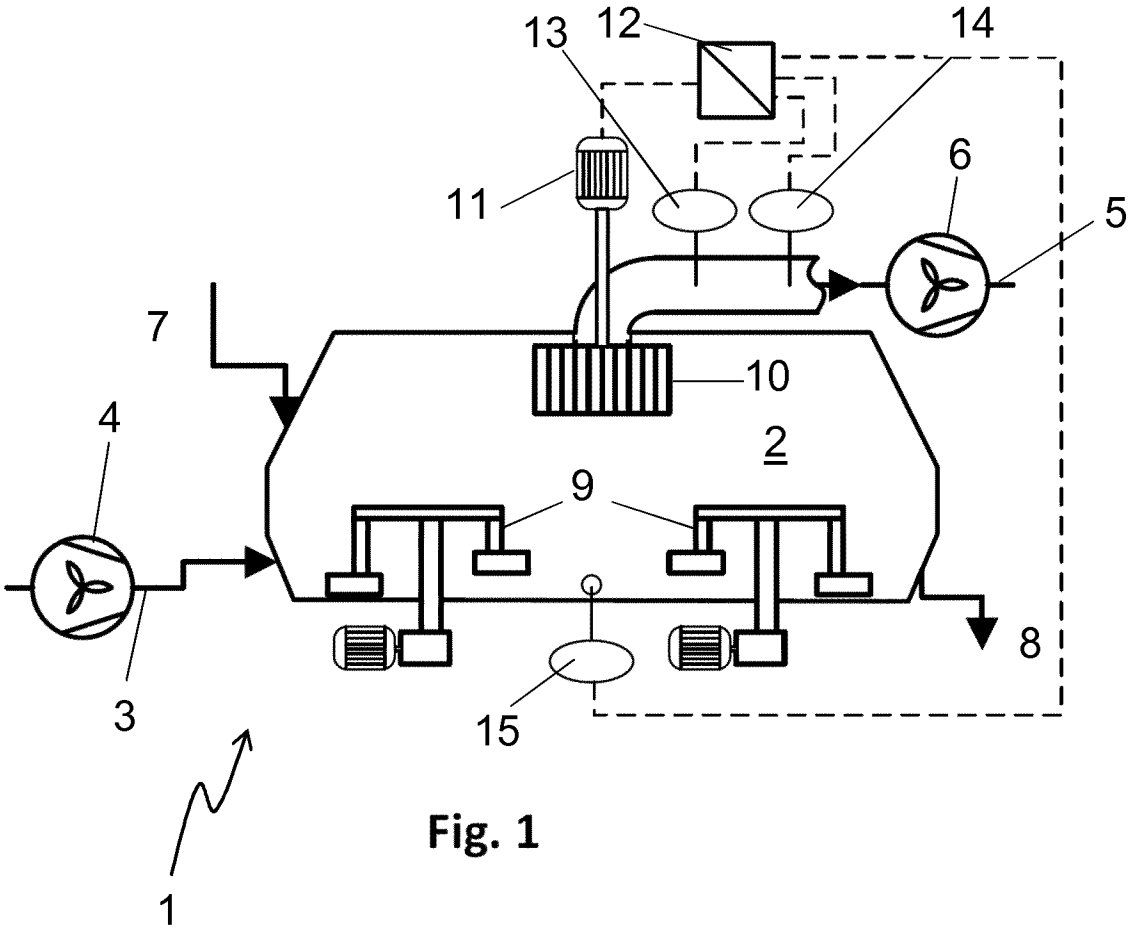
FIG. 1 shows a diagrammatic view of a first embodiment of the invention.

FIG. 1 shows a first embodiment of a casting sand cooler 1. It has a sand chamber 2 as well as an air inlet 3 with a corresponding fan 4 and an air outlet 5 with a corresponding fan 6.

In addition there is a casting sand inlet 7 by way of which casting sand to be cooled can be introduced into the sand chamber 2 and a casting sand outlet 8 by way of which casting sand can be taken from the chamber. Arranged within the sand chamber 2 are two motor-driven mixing tools 9. The connection to the air outlet 5 is let in the upper wall of the sand chamber 2. Arranged in that region is a dynamic wind sifter 10 which can be rotated about a vertical axis. Here the sifter comprises a substantially cylindrical wheel, at the peripheral surface of which are arranged a plurality of mutually spaced plates so that air can flow radially inwardly through the plates in order to be sucked away by way of the air outlet 5.

As in operation the dynamic wind sifter 10 rotates about its vertical axis, for which purpose a motor 11 is used, a centrifugal force field is generated in the region of the plates, which force field can only be overcome by particles smaller than a given limit grain size.

In addition the illustrated embodiment has a quantitative air sensor 14 with which the amount of air sucked away by way of the air outlet 5 can be measured. In addition there is a particle discharge sensor 13 which for example can be in the form of a triboelectric filter monitor or particle counter or in the form of an online particle size measuring device. In addition a moisture sensor 15 is arranged in the region of the sand chamber 2. The sensors are all connected to an open-loop and closed-loop control unit 12 which evaluates the corresponding measurement signals and which on the basis of the measurement sets the rotary speed of the motor 11 to set the desired limit grain size.

Figure 2:
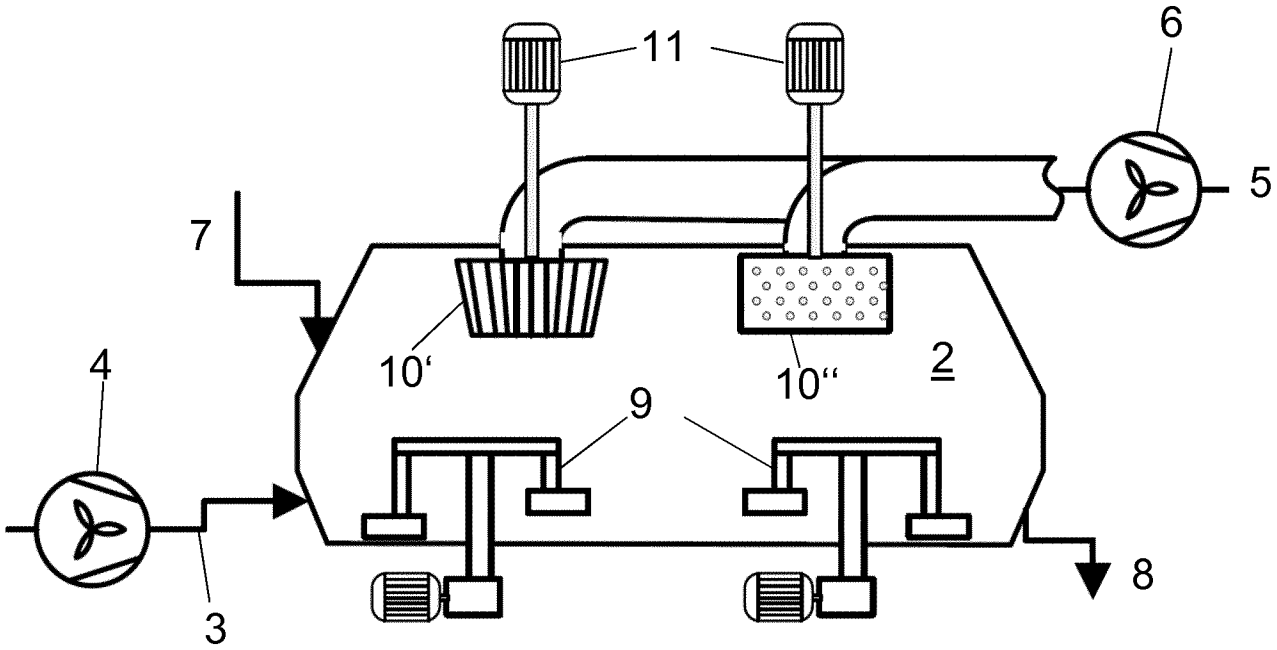
FIG. 2 shows a diagrammatic view of a second embodiment of the invention.

FIG. 2 shows a second embodiment of the invention which differs from the embodiment of FIG. 1 substantially in that here two dynamic wind sifters 10' and 10" are provided, which are respectively connected to the air outlet 5 by way of separate conduits. The dynamic wind sifter 10' is arranged closer to the casting sand inlet 7 than the other dynamic wind sifter 10". It will be seen in this embodiment that the form of the dynamic wind sifter can be selected to be different. While the wind sifter 10' is of a frustoconical shape and also has plates the dynamic wind sifter 10" is again cylindrical but has a plurality of holes in its peripheral surface.

The geometry of the dynamic wind sifter can be adapted in dependence on the desired process implementation.

Figure 3:
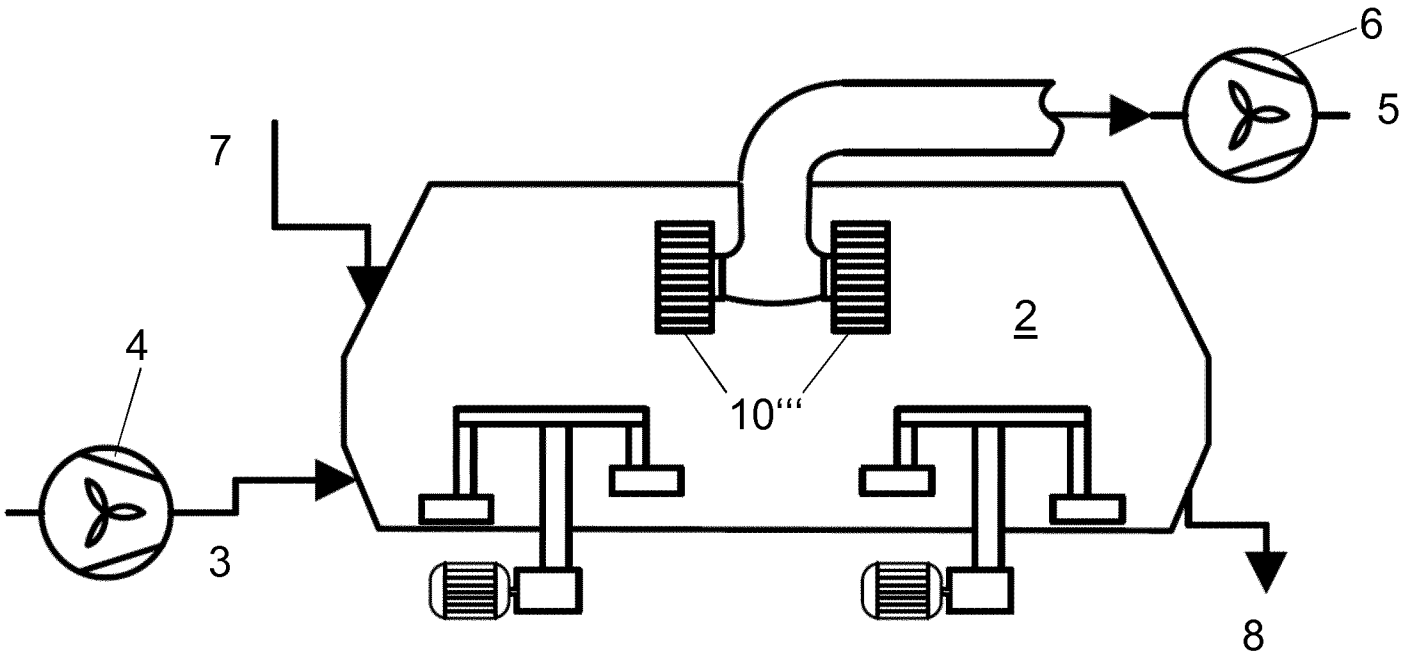
FIG. 3 shows a diagrammatic view of a third embodiment of the invention.

FIG. 3 shows a third embodiment of the invention. It differs from the previous embodiments substantially in that here two dynamic wind sifters 10''' which are identical are connected to the air outlet by way of the same air outlet conduit 5.

Figure 4:
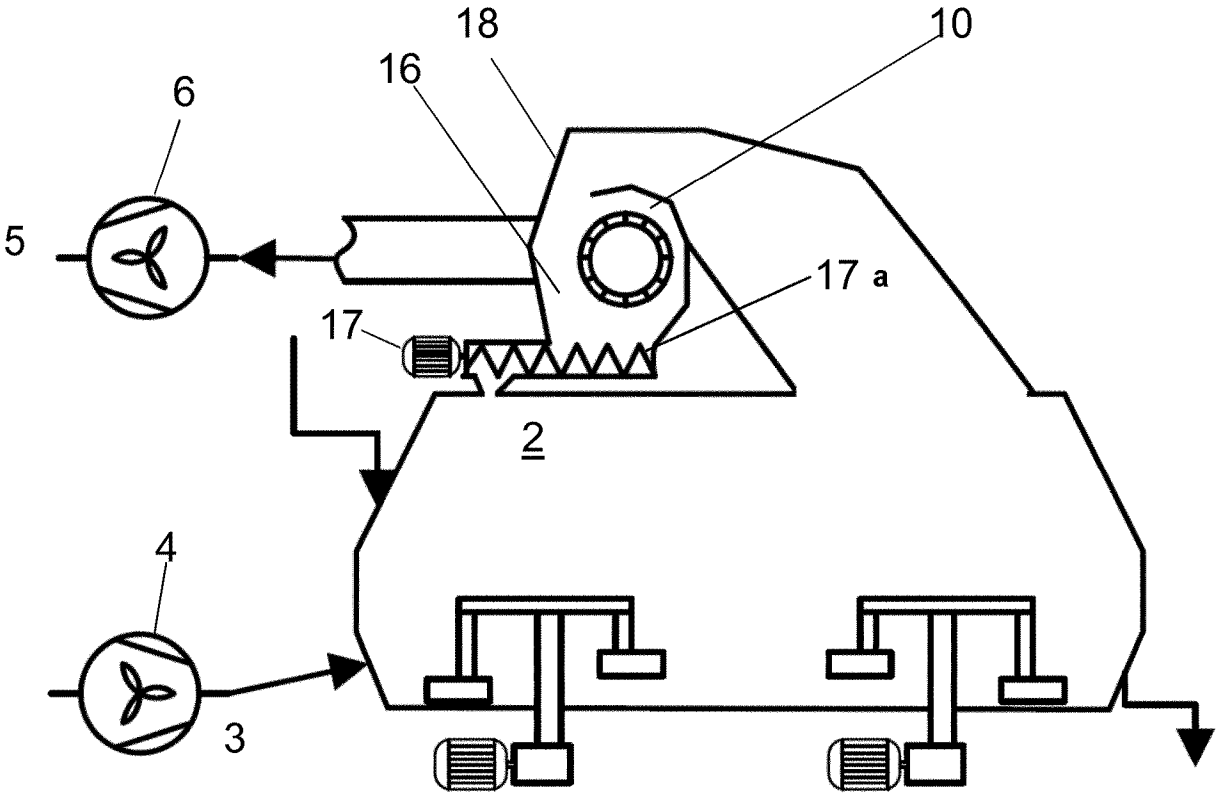
FIG. 4 shows a diagrammatic view of a fourth embodiment of the invention.

FIG. 4 shows a fourth embodiment of the invention. Here the sifter 10 is not arranged within the sand chamber 2 but in a separate sifter chamber 16. The sifter chamber 16 is connected to the sand chamber 2 by way of a connecting passage 17*a* which narrows in the flow direction. The narrowing configuration of the connecting passage 17*a* provides that the flow speed of the air flow increases in the direction of the sifter chamber 16. The arrangement illustrated here forms at the end of the connecting portion 17*a* a sharp deflection so that a part of the sand, namely substantially the parts of the sand which cannot follow the air flow in the region of the sharp deflection by virtue of the inertia forces impinge against the wall 18 and are decelerated. Those sand particles then drop on to the bottom of the sifter chamber 16. The remaining air-sand flow is then passed through the sifter 10 which here rotates about a horizontal axis and by which sand portions whose diameter is larger than a limit grain size are also rejected. The particles which are smaller are drawn off by way of the air outlet. The particles collecting at the bottom of the sifter chamber 16 are conveyed back into the sand chamber 2 by means of the conveyor device 17 which here is in the form of a conveyor screw.

FIGS. 1 to 4 show embodiments in which casting sand cooling can be effected both continuously and also discontinuously. In the discontinuous case a given amount of casting sand is introduced into the sand chamber 2, the casting sand is then cooled and the casting sand is then completely removed by way of the casting sand outlet 8 so that in the following step it can be loaded with the next casting sand batch.

Figure 5:
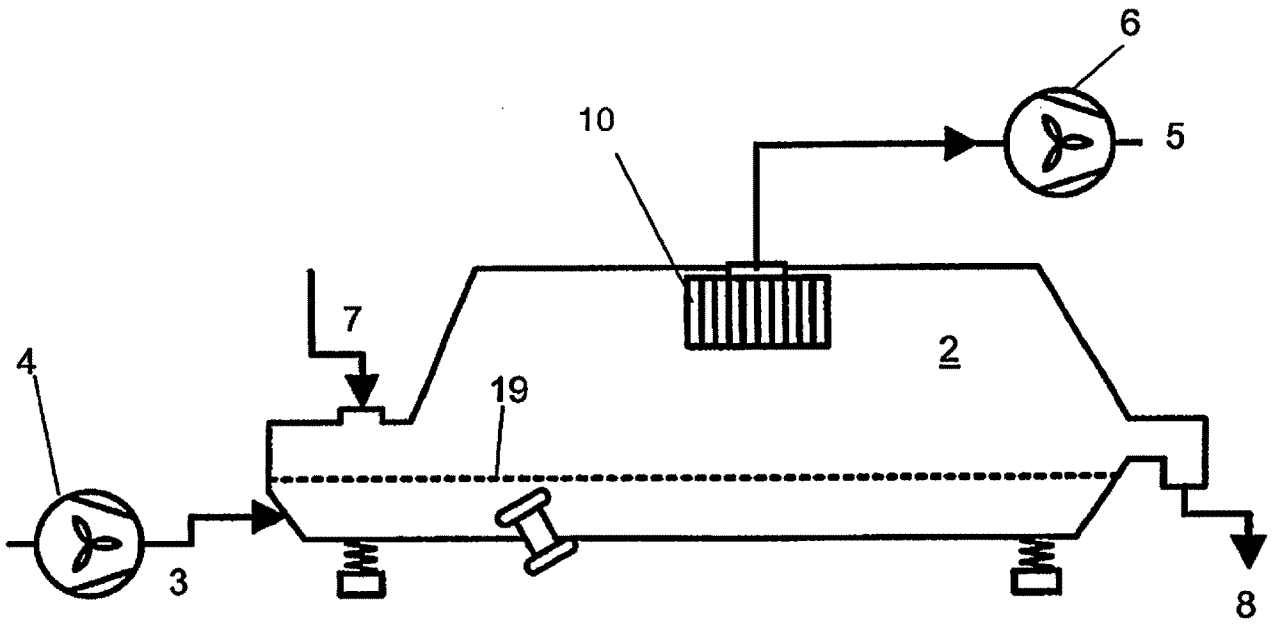
FIG. 5 shows a diagrammatic view of a fifth embodiment of the invention.

FIG. 5 shows a fifth embodiment in which casting sand cooling is effected continuously. Here, a fluidised bed 19 is arranged in the interior of the sand chamber 2 so that casting sand which is introduced by way of the casting sand inlet 7 is transported by way of the fluidised bed 19 gradually but continuously in the direction of the casting sand outlet 8. During such transport a large amount of air is fed into the sand chamber by way of the air inlet 3 and discharged by way of the air outlet 5. A dynamic sifter 10 is interposed.

Figure 6:
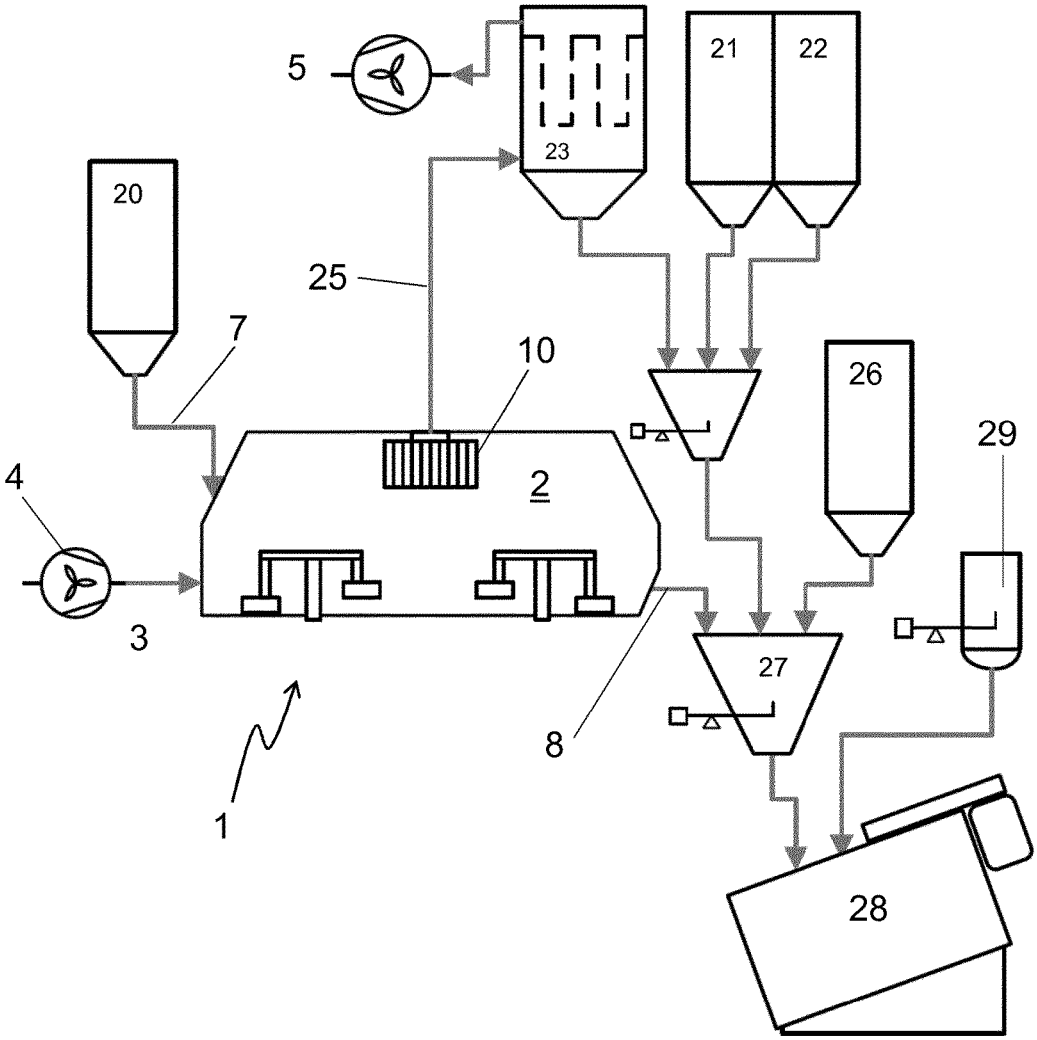
FIG. 6 shows a diagrammatic view of a sixth embodiment of the invention.

FIG. 6 shows a sixth embodiment of the invention. The entire process of casting sand treatment can be explained on the basis of this embodiment. Used casting sand 20 is introduced into the sand chamber 2 by way of the casting sand inlet 7. The casting sand cooler here substantially corresponds to the embodiment of FIG. 1, in which respect however there is provided rotary speed regulation which in the manner according to the invention implements separation as between coarse and fine material. The casting sand to be cooled in the sand chamber is possibly mixed with water and then has a large amount of air flowing therethrough, the air being introduced into the sand chamber 2 by way of the air inlet 3. The air is passed by way of the dynamic sifter 10, by way of the connecting conduit 25 and by way of a filter 23 through the air outlet 5. The sifter 10 is set by means of the control device in such a way that sand components, that is to say particles of a size of greater than 100 μm are rejected by the sifter. Smaller particles however are passed through by the sifter. These are essentially bentonite and carbon. They are filtered off in the filter 23 and passed into the weighing device 24. The amount of bentonite-carbon mixture which is separated off is measured in the weighing device 24 and possibly corrected by the addition of fresh bentonite 21 or carbon 22. As soon as the casting sand is cooled to the desired temperature of about 45° within the sand chamber 2 the sand can be transferred into the weighing device 27 by way of the casting sand outlet 8. Bentonite and carbon in the desired composition can then be fed to the weighing device 27 by way of the weighing device 24. Fresh sand 20 possibly also has to be supplied. The resulting mixture is then fed to a treatment mixer 28 and the proportion of water in the casting sand is possibly adapted by way of the water supply 29 in the treatment mixer 28.

The invention claimed is:

1. A casting sand cooler comprising a sand chamber (2) having an air inlet (3) and an air outlet (5), wherein the air inlet (3) has a fan for the feed of air into the sand chamber (2) and/or the air outlet (5) has a fan for sucking air out of the sand chamber (2), wherein a device for feeding water into the sand chamber is provided, characterised in that a dynamic wind sifter (10) which is rotatable about an axis and which is so arranged within the casting sand cooler and is operable such that substantially the complete air flow leaving the sand chamber (2) through the air outlet (5) is passed through the dynamic wind sifter (10) and solid particles are removed from the discharge air flow and remain in the sand chamber (2) or can be recycled thereinto.

2. A casting sand cooler according to claim 1 characterised in that the dynamic wind sifter (10) has a sifter wheel which is rotatable about an axis of rotation and which has an outlet which substantially surrounds the axis of rotation and which is connected to the air outlet (5), and which has at least one inlet not arranged on the axis of rotation.

3. A casting sand cooler according to claim 2 characterised in that the sifter wheel is cylindrical, conical or frustoconical, the at least one inlet being arranged at the peripheral surface of the sifter wheel.

4. A casting sand cooler according to claim 2 characterised in that the axis of rotation is oriented vertically, horizontally or inclinedly relative to the vertical.

5. A casting sand cooler according to claim 2 characterised in that the casting sand cooler (1) has a casting sand inlet (7) by way of which casting sand can be fed into the sand chamber (2) and a casting sand outlet (8) by way of which casting sand can be removed from the sand chamber (2), wherein there are provided at least two dynamic wind sifters (10) which respectively have a sifter wheel rotatable about an axis of rotation, wherein preferably one wind sifter is arranged closer to the casting sand outlet (8) than the other wind sifter.

6. A casting sand cooler according to claim 5 characterised in that the two wind sifters (10) have drives so designed that the wind sifters are operated in operation at differing rotary speeds.

7. A casting sand cooler according to claim 1 characterised in that a static wind sifter separator, is disposed upstream of the dynamic wind sifter (10).

8. A casting sand cooler according to claim 7 characterised in that the casting sand cooler (1) has a sifter chamber (16) in which the dynamic wind sifter (10) is arranged and the sand chamber (2) is connected to the sifter chamber (16) by way of a flow passage whose cross-section becomes smaller in the direction of the sifter chamber (16).

9. A casting sand cooler according to claim 8 characterised in that the sifter chamber (16) is connected to the sand chamber (2) by way of a return passage.

10. A casting sand cooler comprising a sand chamber (2) having an air inlet 3) and an air outlet (5), wherein the air inlet (3) has a fan for the feed of air into the sand chamber (2) and/or the air outlet (5) has a fan for sucking air out of the sand chamber (2), wherein a device for feeding water into the sand chamber is provided, characterised in that a dynamic wind sifter (10) which is rotatable about an axis and which is so arranged within the casting sand cooler and is operable such that substantially the complete air flow leaving the sand chamber (2) through the air outlet (5) is passed through the dynamic wind sifter (10) and solid particles are removed from the discharge air flow and remain in the sand chamber (2) or can be recycled thereinto, wherein a static wind sifter, preferably a deflection separator, is disposed upstream of the dynamic wind sifter (10), wherein the casting sand cooler (1) has a sifter chamber (16) in which the dynamic wind sifter (10) is arranged and the sand chamber (2) is connected to the sifter chamber (16) by way of a flow passage whose cross-section becomes smaller in the direction of the sifter chamber (16), wherein there is provided a conveyor device (17) in order to convey loose material collected on the bottom of the sifter chamber (16) into the sand chamber (2).

11. A casting sand cooler according to claim 1 characterised in that there is provided a rotary speed device (12) for open-loop or closed-loop control of the rotary speed of the dynamic wind sifter (10).

12. A casting sand cooler according to claim 11 characterised in that there is provided a device (14) for detecting the air flow through the air outlet (5), wherein the detected air flow is made available to the rotary speed device (12).

13. A casting sand cooler according to claim 11 characterised in that the casting sand cooler (1) is a batch casting sand cooler, wherein the rotary speed device (12) is so adapted that the rotary speed is increased during the casting sand cooling operation.

14. A casting sand cooler according to claim 11 characterised in that there is provided a device for detecting the particle discharge by way of the air outlet (5), wherein the detected particle discharge is made available to the rotary speed device (12).

15. A casting sand cooler according to claim 11 characterised in that there is provided a moisture sensor for detecting the moisture in the sand in the sand chamber (2), wherein the moisture sensor is connected to the rotary speed device and same is so designed that the rotary speed is subjected to open-loop or closed-loop control in dependence on the detected moisture.

16. A casting sand cooler according to claim 8 wherein the flow passage is so arranged that the fluid flow passed from the sand chamber by way of the flow passage into the sifter wheel is directed on to a wall of the sifter chamber (16) and not on to the dynamic sifter.

17. A casting sand cooler according to claim 12 wherein the rotary speed device is so adapted that the rotary speed is subjected to open-loop or closed-loop control in dependence on the detected air flow.

18. A casting sand cooler according to claim 14 wherein the rotary speed device is so adapted that the rotary speed is subjected to open-loop or closed-loop control in dependence on the detected particle discharge.

19. A casting sand cooler according to claim 11 wherein there is provided a water control device to which the detected particle discharge and optionally the rotary speed of the dynamic wind sifter (10) are made available and which is so designed that the fed amount of water is effected in dependence on the detected particle discharge and optionally the rotary speed of the dynamic wind sifter (10).

20. A casting sand cooler according to claim 1, characterized in that a mixing tool is arranged within the sand chamber.

* * * * *